United States Patent [19]

Dworak

[11] 4,402,654

[45] Sep. 6, 1983

[54] FLUID-OPERATED GEAR MACHINE

[75] Inventor: Wilhelm Dworak, Stuttgart, Fed. Rep. of Germany

[73] Assignee: Robert Bosch GmbH, Stuttgart, Fed. Rep. of Germany

[21] Appl. No.: 241,741

[22] Filed: Mar. 9, 1981

[30] Foreign Application Priority Data

Mar. 13, 1980 [DE] Fed. Rep. of Germany ..... 3009570

[51] Int. Cl.[3] ..... F04C 15/00; F01C 19/08

[52] U.S. Cl. ..... 418/131; 418/132; 418/205; 418/206

[58] Field of Search ..... 418/131, 132, 206, 205

[56] References Cited

FOREIGN PATENT DOCUMENTS 647659 8/1962 Canada ..... 418/131

1253584 11/1967 Fed. Rep. of Germany ..... 418/131

*Primary Examiner*—Charles J. Myhre

*Assistant Examiner*—E. Rollins Cross

*Attorney, Agent, or Firm*—Michael J. Striker

[57] ABSTRACT

An arrangement for aligning a drive shaft of a fluid-operated gear machine having a cover enclosing a housing of the machine is provided. The aligning arrangement includes a plate connected to the axial end face of the cover, which side is directed to a pair of meshing gears mounted within the housing of the machine. This plate is formed with an opening receiving the drive shaft without a play when the cover is placed in a position in which it sealingly closes the housing.

10 Claims, 3 Drawing Figures

FLUID-OPERATED GEAR MACHINE

BACKGROUND OF THE INVENTION

This invention relates to a fluid-operated machine, and more particulary to a fluid machine of the type which can be used as a pump or as a fluid motor.

Fluid machines are already known, having two externally meshing gears the shafts of which are mounted in bores of journalling bearings. The meshing gears and the shafts, of which one shaft is usually a drive shaft, are located in a chamber of a housing which is sealingly closed with a cover. This cover has a bore through which the drive shaft passes with a relatively large play. The fluid-operated machines capable of being used as a fluid pump or a fluid motor are usually coupled to an external element, such as for example, a flange of an electromotor in case the fluid-operated machine is a pump. In this instance the drive shaft should be aligned with the aforementioned external element. It is to be noted that the drive shaft mounted without the bearings is not rigid within the housing but is positioned therein with a certain radial play. Since the drive shaft is received within the bore of the cover also with a play it is impossible to easily center the drive shaft with the cover. In the devices known in the prior art, a special additional equipment has been used for centering the drive shaft to the cover sealingly closing the housing of the pump. Such additional equipment, however, is rather expensive and inconvenient in assembling of the pump or motor.

SUMMARY OF THE INVENTION

Accordingly, it is an object of this invention to overcome the disadvantages of the prior art.

More particularly, it is an object of this invention to provide an improved fluid-operated gear machine.

Still another object of the invention is to provide a centering arrangement of maximum simplicity, efficiency, economy and ease of assembly.

These and other objects of the present invention are attained by a fluid-operated gear machine, comprising a housing having a chamber, a drive shaft positioned in said chamber and having a portion extending outwardly of said housing, a pair of meshing gears located in said chamber, one of said gears being mounted on the drive shaft, bearing means surrounding said drive shaft for supporting the shaft within the housing, said bearing means being positioned within said chamber with a radial play, a cover sealingly closing the housing and having a bore through which the drive shaft passes, said cover having a side facing toward said bearing means, and means for aligning the drive shaft to the cover, said aligning means including a plate connected to said side of the cover and having an opening adapted to receive said drive shaft when said cover is placed in a position in which it sealingly closes the housing.

The aligning plate has an external periphery and the chamber of the housing has a peripheral surface, the configuration of the external periphery of the plate substantially corresponding to the peripheral surface of the housing chamber. The plate may surround the drive shaft with a very small play.

The aligning plate may be glued to the face side of the cover or, alternatively, soldered to said side of the cover.

The aligning plate may be formed with a portion extended into a space between said bore of the cover and the drive shaft so that this portion surrounds the drive shaft with a very small play. This portion of the plate may be rolled into the bore of the cover.

The plate may also be formed with a plurality of recesses radially outwardly extended from the opening formed in said plate. These recesses are circumferentially spaced from one another.

The aligning arrangement for centering a drive shaft of the pump or a fluid motor to a cover closing the housing of the machine is effective and easy in assembling and does not require any additional equipment for achieving the object of the invention. This aligning is obtained by mere adjusting of the cover relative to the housing which is rather simple and inexpensive.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
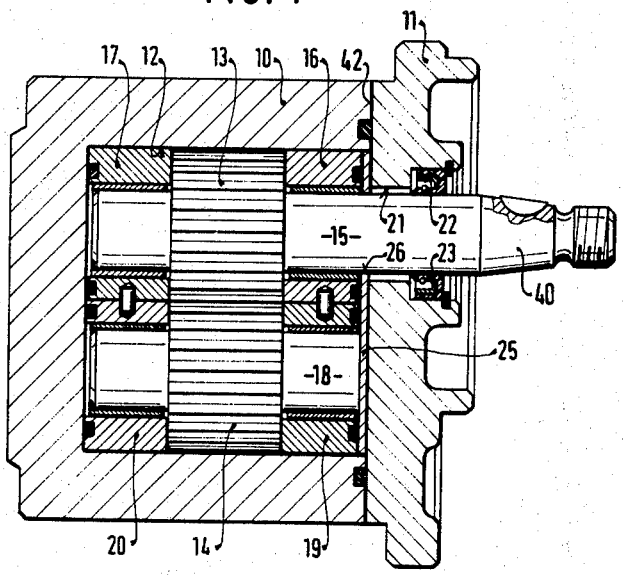
FIG. 1 is an axial section through a gear machine according to the invention.
Figure 3:
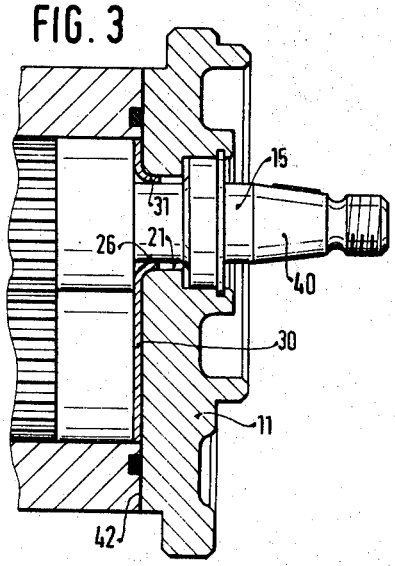
FIG. 3 is a partial sectional view of the gear machine showing a modification of the aligning plate of the invention.

The invention is illustrated by way of example as incorporated in the gear pump which is shown in FIGS. 1 and 3. The gear pump has a housing 10 formed with a chamber 12 to accommodate two externally meshing gears 13 and 14. A drive shaft 15 carries a gear 13 whereas a second shaft 18 carries the meshing gear 14. The drive shaft 15 is supported in a conventional fashion in two journalling sleeve-shaped bearings 16 and 17 whereas the shaft 18 is supported in two similar sleeve-shaped bearings 19 and 20.

It should be noted that the teeth of the gears 13 and 14 mesh with one another so that the gears can perform a pumping function or act as a motor, in accordance with the operation of such gear machines which is known in the art.

The bearings 16, 17 and 19, 20 are mounted in the chamber 12 with a certain radial play which is necessary for proper running of the gears in operation.

The housing 10 has an open end which is sealingly closed with a cover 11. The cover 11 is formed with a bore 21 which serves to receive the drive shaft 15. The drive shaft 15 projects through the end cover 11 to form an output portion 40 which extends outwardly from the housing 10 to be coupled with an external element (not shown). The shaft 15 extends through the bore 21 with a relatively large play. The shaft seal 23 is arranged in a widening portion 22 of the bore 21 to seal the opening through which the output portion 40 extends.

According to the invention a relatively thin metallic plate 25 is mounted between the cover 11 and sleeve bearings 16 and 19. The plate 25 is rigidly connected to the axial end face 42 of the cover 11 by means of soldering or gluing or any other conventional means. The plate 25 is provided with an opening 26 adapted to receive the drive shaft 15. The plate 25 surrounds the shaft 15 by its opening 26 so that there is almost no play between shaft 15 and the opening 26. By means of the centering plate 25, the drive shaft 15 may be reliably centered within the cover 11 and aligned therewith as soon as the cover 11 is adjusted to the housing. In this case, there is no need for the additional arrangement which has been utilized in assembling of the devices known in the art.

Figure 2:
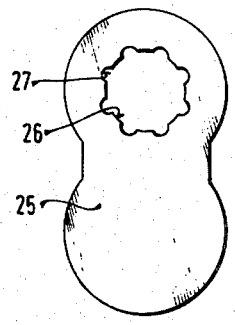
FIG. 2 is an aligning plate according to the invention.

In operation, the eventual wear of the parts of the gear machine may cause a displacement of the drive shaft 15 within the opening 26. This, however, may be cured by selection of corresponding materials for the parts of the gear machine and therefore is not critical. However, in order to reduce wear of the parts of the gear machine (which wear may result in disalignment of the drive shaft 15 within the cover 11) a number of recesses 27 (FIG. 2) has been suggested in the plate 25. Recesses 27 extend radially and outwardly from the opening 26 and are spaced from one another in a circumferential direction. Recesses 27 are spaced from one another in such a manner that the sufficient bearing surface of the opening 26 for the drive shaft 15 will still be maintained.

FIG. 3 illustrates another embodiment of the aligning plate which is denoted in this embodiment by a numeral 30. The plate 30 is formed with an axially projected rim 31 which is extended into the bore 21 so that the rim 31 surrounds a portion of the drive shaft 15 and centers the latter with the cover 11. The plate 30 is also connected to the axial end face of the cover 11 by gluing or soldering or any other conventional means suitable for this purpose.

It is to be understood that the configuration of the plate 25 or the portion of the plate 30 adjacent to the axial end face 42 of the cover 11 is accommodated to the cross-sectional configuration of the chamber 12 so that the external surface of the plates 25 or 30 is centered within the housing 10.

It will be understood that each of the elements described above, or two or more together, may also find a useful application in other types of a fluid-operated gear machine differing from the types described above.

While the invention has been illustrated and described as embodied in gear machines it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristic of the generic or specific aspects of this invention.

What is claimed as new and desired to be protected by Letters Patent is set forth in the appended claims:

1. A fluid-operated gear machine, comprising a housing having a chamber; a drive shaft positioned in said chamber and having a portion extending outwardly of said housing; a pair of meshing gears located in said chamber, one of said gears being mounted on said drive shaft; bearing means surrouding said drive shaft for supporting said shaft within said housing, said bearing means being positioned within said chamber with a radial play; a cover sealingly closing said housing and having a bore through which said drive shaft passes, said cover having a side facing toward said bearing means; and means for aligning said drive shaft to said cover, said aligning means including a centering plate disposed between said cover and said bearing means and connected to said side and having an opening receiving and centering said drive shaft when said cover is placed in a position in which it sealingly closes said housing.

2. The machine of claim 1, wherein said plate has an external periphery and said chamber has an inner peripheral surface, the size and configuration of said external periphery substantially corresponding to the size and configuration of said peripheral surface.

3. The machine of claim 2, wherein said plate surrounds said drive shaft with a very small play.

4. The machine of claim 3, wherein said plate is glued to said side of said cover.

5. The machine of claim 3, wherein said plate is soldered to said side of said cover.

6. The machine of claim 3, wherein said plate is formed with a portion extended into a space between said bore of said cover and said drive shaft so that said portion surrounds said shaft with a very small play.

7. The machine of claim 6, wherein said portion of said plate is rolled into said bore.

8. The machine of claim 3, wherein said plate is formed with a plurality of recesses radially outwardly extended from said opening, said recesses being circumferentially spaced from one another.

9. The machine of claim 2, wherein said plate surrounds said drive shaft such that almost no radial play is formed between said opening and said drive shaft.

10. The machine of claim 9, wherein said plate is rigidly connected to said side of said cover.

* * * * *